US007053309B2

(12) United States Patent
Efraimsson et al.

(10) Patent No.: US 7,053,309 B2
(45) Date of Patent: May 30, 2006

(54) CABLE WITH SHIELDING STRIP

(75) Inventors: Lars Efraimsson, Falun (SE); Ulf Johnsen, Falun (SE); Anders Gatu, Vikarbyn (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 44 days.

(21) Appl. No.: 10/513,210

(22) PCT Filed: May 27, 2003

(86) PCT No.: PCT/SE03/00864

§ 371 (c)(1),
(2), (4) Date: May 17, 2005

(87) PCT Pub. No.: WO2004/006272

PCT Pub. Date: Jan. 15, 2004

(65) Prior Publication Data

US 2005/0217890 A1 Oct. 6, 2005

(30) Foreign Application Priority Data

May 27, 2002 (SE) ..... 0201589

(51) Int. Cl.
*H01B 11/02* (2006.01)

(52) U.S. Cl. ..... 174/113 R; 174/102 SC; 174/116

(58) Field of Classification Search ..... 174/36, 174/113 R, 102 R, 106 R, 102 D, 102 SC, 174/120 SC, 116
See application file for complete search history.

(56) References Cited

U.S. PATENT DOCUMENTS 3,211,821 A * 10/1965 Wakefield ..... 174/26 R
RE30,228 E * 3/1980 Silver et al. ..... 174/36
4,963,695 A 10/1990 Marciano-Agostinelli et al.

FOREIGN PATENT DOCUMENTS

DE 3229976 A1 2/1984
EP 0391012 A1 10/1990
EP 0416728 A2 3/1991
EP 0700057 A2 3/1996

OTHER PUBLICATIONS

Swedish Patent Office, International Search Report for PCT/SE03/00864, Dated Aug. 26, 2003.

* cited by examiner

*Primary Examiner*—Chau N. Nguyen
(74) *Attorney, Agent, or Firm*—Roger Burleigh

(57) ABSTRACT

The figure shows an electrical cable with conductors (1) of metal, surrounded by each of an inner conducting layer (2), insulation (3) and an outer conducting layer (4). A moisture barrier (11) with an electrically conducting layer surrounds the conductors. Shield strips (5) of at least partially conducting material are located in the regions between the outer conducting layer (4) and the moisture barrier (11). Electrically conducting shield wires (6) run along the shield strips and are placed through these into electrical contact with the electrically conducting layer of the moisture barrier (11). The shield strips support the moisture barrier from the inside, such that the moisture barrier can in a simple manner be made watertight when it is applied. The shield strips (5), the moisture barrier (11) and the shield wires (6) together constitute an efficient electrical shield for the cable. Penetration of an electrically conducting object into the cable results in a fault current that can be easily indicated, such that an applied cable voltage can be removed.

10 Claims, 5 Drawing Sheets

CABLE WITH SHIELDING STRIP

TECHNICAL FIELD OF THE INVENTION

The present invention concerns an insulated electrical cable with a shield of metallic foil for making it watertight in the radial direction and a jacket arranged outside of the shield.

DESCRIPTION OF RELATED ART

Insulated electrical cables for high voltages (>3 kV) are normally constructed in such a manner that that they consist of, from the centre, at least one conductor, at least one inner conducting layer, insulation, at least one outer conducting layer, a shield, and, externally, a jacket. The said type of cable is normally manufactured by what is known as "triple extrusion", in which all three inner layers are extruded onto the conductor in a single process. The shield and the jacket are subsequently applied in a subsequent step. The most common insulation material is cross-linked polyethene (PEX).

The role of the shield is both to ensure that the outer conducting layer is maintained at electrical earth potential by conducting any capacitive eddy currents that may arise, and also to provide in the event of damage that gives rise to a short-circuit a return path of sufficiently low ohmic resistance for the current, in order to ensure adequate personal safety and in order to ensure sufficient short-circuit current such that existing protection will disconnect the supply voltage.

The role of the jacket is not only that of electrically insulating the shield from its surroundings, but also that of providing mechanical and chemical protection from the surroundings.

It has become apparent that a phenomenon known as "water treeing" can arise in the insulation, which degrades the insulation, possibly leading to flash-over. Water treeing principally occurs for cables with voltages exceeding 3 kV AC in combination with the insulation being exposed to a humidity exceeding 70%. For this reason, therefore, it is required that a moisture barrier against water is introduced for certain cables. This barrier should consist of metallic material.

Cable designs for voltages greater than 3 kV are also available, having insulation of XPLE. The shield in these cables consists of a thick tape of longitudinal aluminium folded over the outer conducting layer. This type of cable is often more rigid than a cable having wire shield and at the same time it may be difficult to make contact with a tape or a foil of aluminium at the end of the cable and at joins.

When a cable is to be radially sealed with a longitudinal foil, it is required that an underlying construction is fairly round. This is often solved for a multi-conductor cable by an underlying filler material being extruded onto the underlying construction before the foil is applied.

SUMMARY OF THE INVENTION

When using cable that requires shield for personal protection and for protection against short-circuits, the shield is normally constructed from copper wires, or a shield of copper wires is used, possibly also having aluminium foil applied to its outside. A galvanic element may arise when copper and aluminium come into contact with each other. Solutions are thus available for cables having copper shield and aluminium foil that minimise this effect. Despite this, major problems with corrosion often arise when the jacket is punctured, and these problems frequently lead to increased pressure and thus degradation of the outer conducting layer and the underlying insulation. The consequence of this is the risk of a complete break-down of the cable and subsequent interruption in electrical supply.

Another problem that may arise is that poor contact between different shield materials may give rise to differences in potential between these materials in the event of excess voltage transients, and this may degrade the outer conducting layer and the underlying insulation, or it may puncture the jacket, leading to the risk of subsequent cable break-down and interruption in electrical supply.

This galvanic corrosion is currently a problem for existing cable designs, in particular in the event of a hole arising in the foil and water penetration occurring. Even if the underlying construction is longitudinally sealed for water, the galvanic corrosion can give rise to a local break in the shield of the cable.

This can be solved by using similar metallic materials for shield wires and the external foil, or by preventing direct contact between the different metallic materials by, for example, baking the shield wires into a filler material that protects from corrosion when different materials for shield wires and foil are used.

In order to prevent the risk for damage to a cable as described above, therefore, the shield of aluminium wires in the present invention can be arranged in contact with an externally applied aluminium foil, whereby no problems arise when conducting away capacitive eddy currents, which currents can arise in the outer conducting layer of the cable when an alternating voltage or a pulsating direct voltage is applied to the cable. This means that differences in galvanic potential between different metallic materials can be avoided such that the problems described above do not arise.

Recycling of cables consisting of different metallic materials is another problem. It is considerably more advantageous with one preferred embodiment, in which conductors and shield are made from aluminium, to recycle material than it is with a construction consisting of different metallic materials. Furthermore, spreading of copper, a heavy metal, in the environment can be avoided by the use of aluminium.

A further advantage with the use of aluminium as material in the shield is that the weight of an aluminium shield is only half that of a shield made from copper if the same resistance is to be obtained in the shield construction.

One difficulty that arises for all cable designs in which a sealing layer of aluminium foil is required, is the presence of a pressure under the foil that resists when the warm jacket is pressed onto the cable and heats the foil layer against itself and against the externally applied jacket.

This has been solved in the present design by inserting profiles into the space that is formed between the included insulated cable conductors/the parts of the cable construction. These profiles/strips can thus also be constructed of filler material that protects against corrosion, where the shield wires are baked into the filler material in order to further ensure that the shield is not broken in the event of damage, such as a hole, to the foil that would cause corrosion to the underlying shield wires.

In order to make the construction watertight in the longitudinal direction, cavities are filled preferably with swelling powder/swelling tape during the cabling process. It is usually sufficient, if the profiles have the correct design, to apply the swelling powder in specially designed chambers in which the electrostatically charged powder is placed. A major advantage of electrostatic application of the powder is a significant reduction in the formation of dust. The second advantage is that all the components, if they conduct to a certain degree, attract powder to themselves, even if they are obscured relative to the location of powder application, in that they attract the electrostatically charged powder particles. This ensures that all component parts of the construction become covered with powder, and in this way the longitudinal watertight sealing in the event of water penetration of the construction is ensured.

Another problem that exists with longitudinally folded tapes is that the change in diameter that occurs on heating can readily give rise to distortion over the join in the foil. In order to minimise this distortion, elements such as soft tapes, milling or the equivalent are often inserted into the construction in order to take care of a part of this heat expansion. Alternatively, or in addition, the plastic jacket may also be of a plastic material that has high strength at high temperatures, such as cross-linked polyethene (PEX).

This has been solved in the present invention for multi-conductor cables in that the tape of metal foil is applied as a tape during the cabling process. This means that the join does not need to absorb all of the heat expansion, and the heat expansion can be distributed more evenly around the foil and on the externally applied jacket. Another difficulty that arises with compact designs such as this one is the ability to open it at the ends and at joins. This can be solved through the invention in that one or several tear-strips are arranged under the external tape of metal foil or, possibly, in at least one shield strip.

The invention will now be described in more detail with the aid of preferred embodiments and with reference to the attached drawings.

DETAILED DESCRIPTION OF EMBODIMENTS

Figure 1:
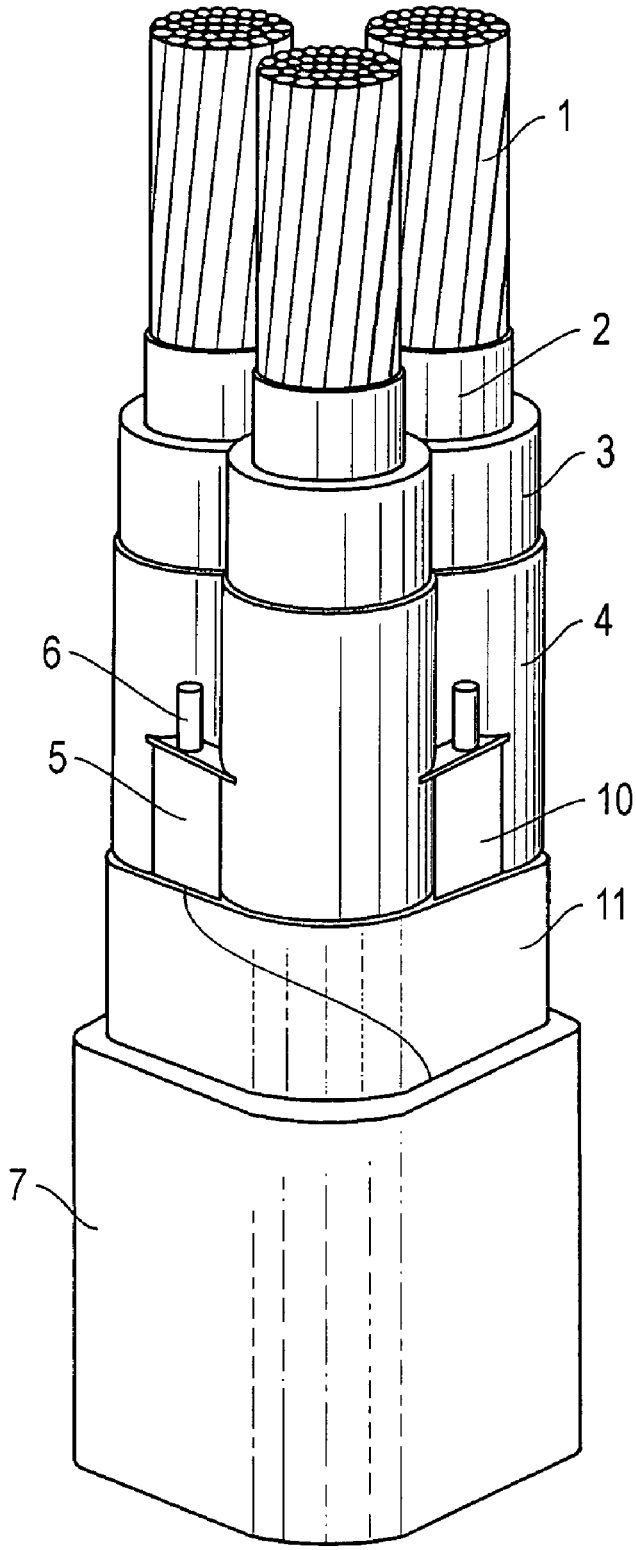
FIG. 1 shows a radial cross-section of an insulated multi-conductor cable arranged according to the invention with a shield consisting of wires baked into a filler material that protects against corrosion formed as profiles to fill the space between the parts and a tape of aluminium, whereby contact is made between the foil and the shield wires in that the filler material is conductive.

In FIG. 1 is shown by radial cross-sections an insulated electrical cable designed according to the invention. The cable consists of three insulated conductors 1, where an inner conducting layer 2, insulation 3 and an outer conducting layer 4 are arranged around each conductor. Several sectorial shield strips 5 with one or several longitudinal shield wires 6 baked into them are present in the space between the outer conducting layer and an outer foil 11 of metal such as aluminium, which strips are arranged to function as a metallic shield. These aluminium wires lie preferably baked into a filler material that protects against corrosion 10, known as shield wire filler material 10, which may be fully or partially conductive and may demonstrate swelling properties when in contact with water, whereby the tape or tapes preferably follow the cabling of the parts. Further, outside of the shield strips and in contact with them, a tape has been arranged that may consist of an aluminium foil 11 partially or wholly in direct galvanic contact with the aluminium shield wires, or in contact with the shield wires through the partially or fully conductive shield wire material. A sliding tape may also have been inserted between the shield strips and the outer metal foil in order to increase the flexibility of the cable and to provide pliability and damping between shield and outer foil. The sliding tape may also have swelling properties in the event of water penetration. Alternatively, depending on requirements and/or external circumstances, it would be possible to use baked-in copper wires in the shield strips and an outer aluminium foil or it would be possible to use copper wires in the shield strips and an outer copper foil.

In order for the construction to be longitudinally watertight, cavities under the aluminium foil are filled, preferably with swelling powder/swelling strips, during the cabling process. Given correctly designed profiles of the strips, it is usually sufficient that the swelling powder is applied in specially designed chambers, into which electrostatically charged powder is applied. A major advantage with electrostatic application of powder is a considerable reduction in dust formation. The second advantage is that all the components, if they conduct to a certain degree, attract powder to themselves, even if they are obscured relative to the location of powder application, in that they attract the electrostatically charged powder particles. This ensures that all component parts of the construction become covered with powder, and in this way the longitudinal watertight sealing in the event of water penetration of the construction is ensured.

By dividing the shield into a number of sectors with conductors of conducting material incorporated into them, and by surrounding these shield sections with a metallic foil that is in contact with the conductors, an arc can be obtained, in the event of a fault on the cable, that creates a conducting plasma through all parts that are included and that are in electrical contact with each other. The light arc or the plasma at the location of the fault are not hindered or delayed given that the contacts partially consist of conducting plastic and rubber material or other conducting material such as carbon-baked paper or non-woven tape. This means that the construction of the shield provides satisfactory current transport to the shield wires, which can then release electrical protection and disconnect the cable from the electrical network.

It is preferable that the aluminium foil used as tape for taping around the cable is milled. A higher flexibility in the manufacturing process is obtained by milling an aluminium-coated plastic tape. The milling also reduces the risk for gaps arising at the tape when the cable is bent over, for example, a cable drum for transport to the next stage in a manufacturing process. The milling also gives a more secure and tighter sealing join at overlaps by reducing the risk for gaps. The milling also provides a greater tolerance for angular deviation, which makes it possible to use a somewhat broader tape for a taping operation of the cable. The tape that will preferably be used consists of an aluminium foil on a polyester foil with copolymer (melting glue), that can be easily glued to foil overlaps and to the surrounding jacket.

A jacket 7, preferably of a polymer material such as polyethene, lies outside of the shield construction 5. Items 2–4 can, when lower voltages, under 3000 volts, are used, be replaced by a homogeneous insulating material.

Figure 2A:
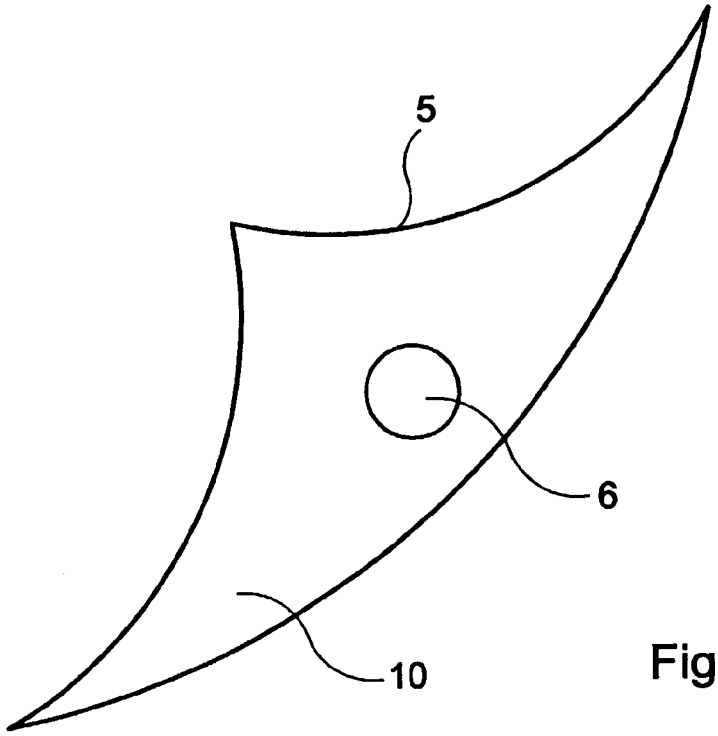
FIGS. 2A–E show various radial cross-sections of shield tapes for a multi-conductor cable arranged according to the invention.
Figure 2B:
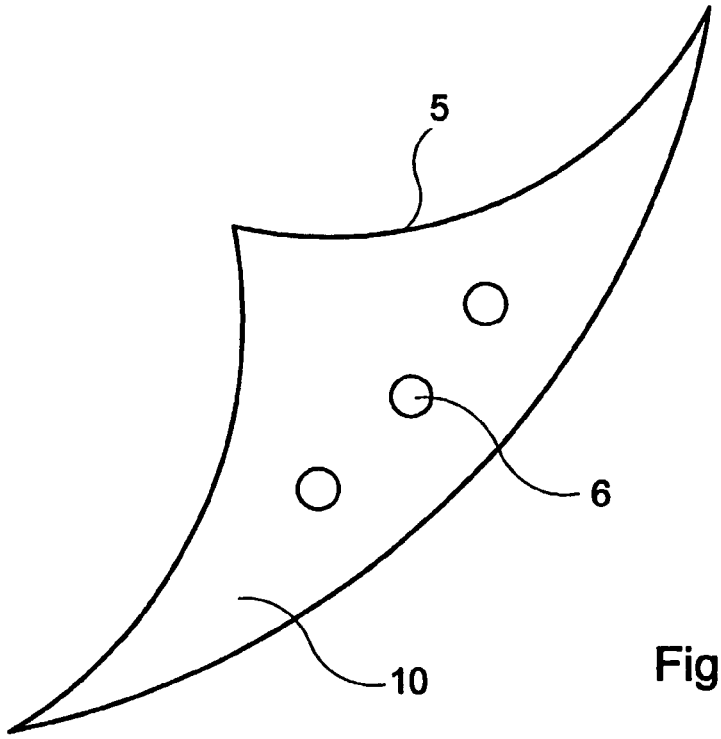

FIGS. 2A and 2B show a shield strip 5 with an essentially triangular cross-section for a shield of a conducting strip with one or several baked-in aluminium wires 6 in a filler material 10 that protects against corrosion, which filler material may be fully or partially conductive, and may demonstrate swelling properties on contact with water, where the strip or strips are preferably arranged to follow the cabling of the parts. Subsequently, a tape can be applied outside of and in contact with the shield strips, which tape may consist of aluminium foil fully or partially in galvanic contact with the aluminium shield wires, either directly or through the fully or partially conducting shield wire filler material. The tape may be designed in different ways such that the surrounding foil acquires adequate pressure when the jacket is applied. Alternative designs of different embodiments are shown in the drawings given below.

Figure 2C:
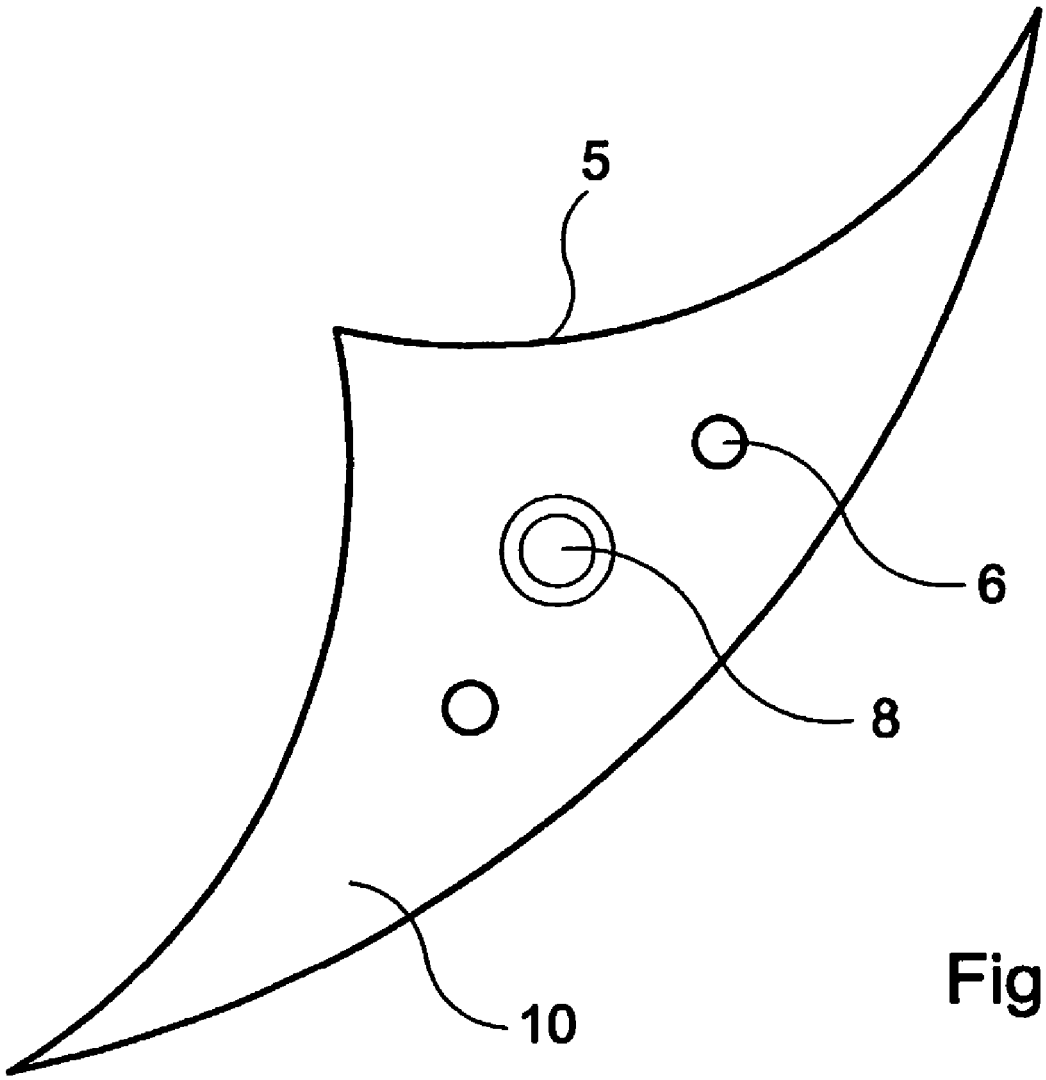

FIG. 2C shows an alternative design, from which it is apparent that a tube 8 for one or several optofibres is also present, in addition to conductors 6, in a cross-section of the shield strips 5.

Figure 2E:
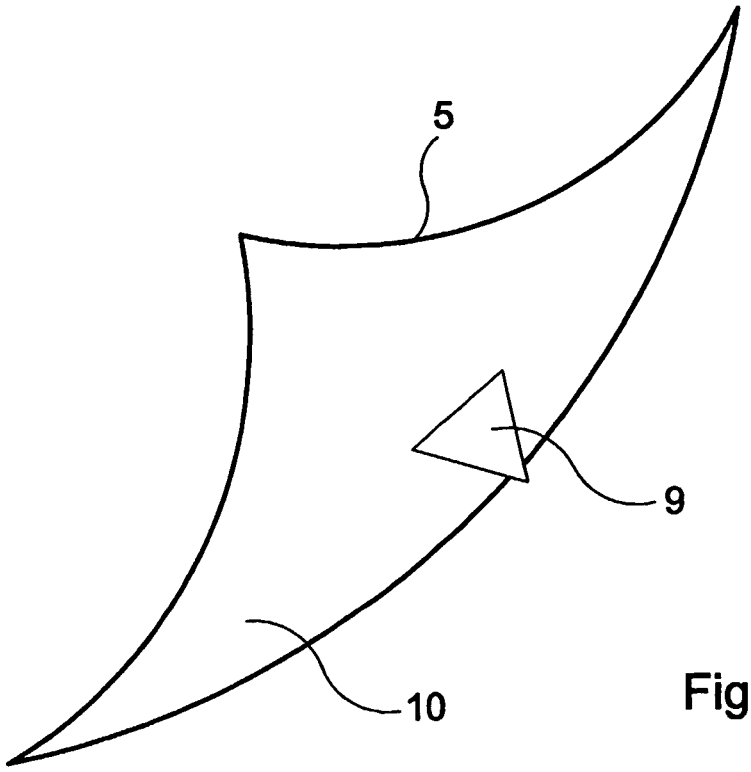
Figure 2D:
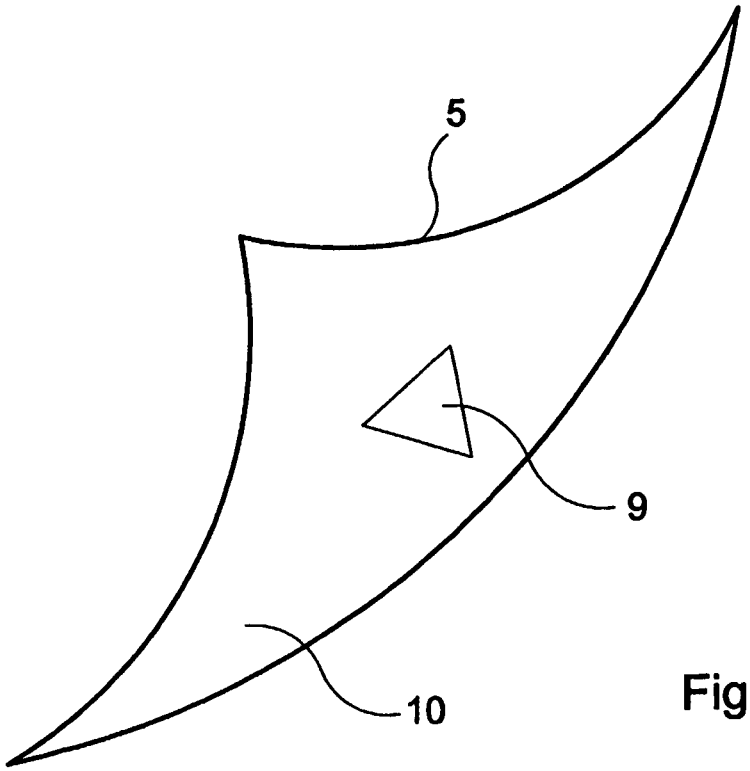

FIGS. 2D and 2E show further variants of the shield strips 5 with one conductor 9 with a triangular cross-section, in which a pointed shape of the conductor is pointed outwards towards the peripheral surface of the shield strip. An improved cutting function through the surrounding metal foil and jacket is obtained with the pointed shape, when the conductor is used as a cutting wire in order to open the cable without needing to damage underlying parts. By allowing the pointed shape to lie outside of and to protrude somewhat from the shield strip as in FIG. 2E, direct galvanic contact is obtained between shield wire and surrounding metal foil in the cable construction. In this case the material around the conductor does not need to be conducting.

Figure 3:
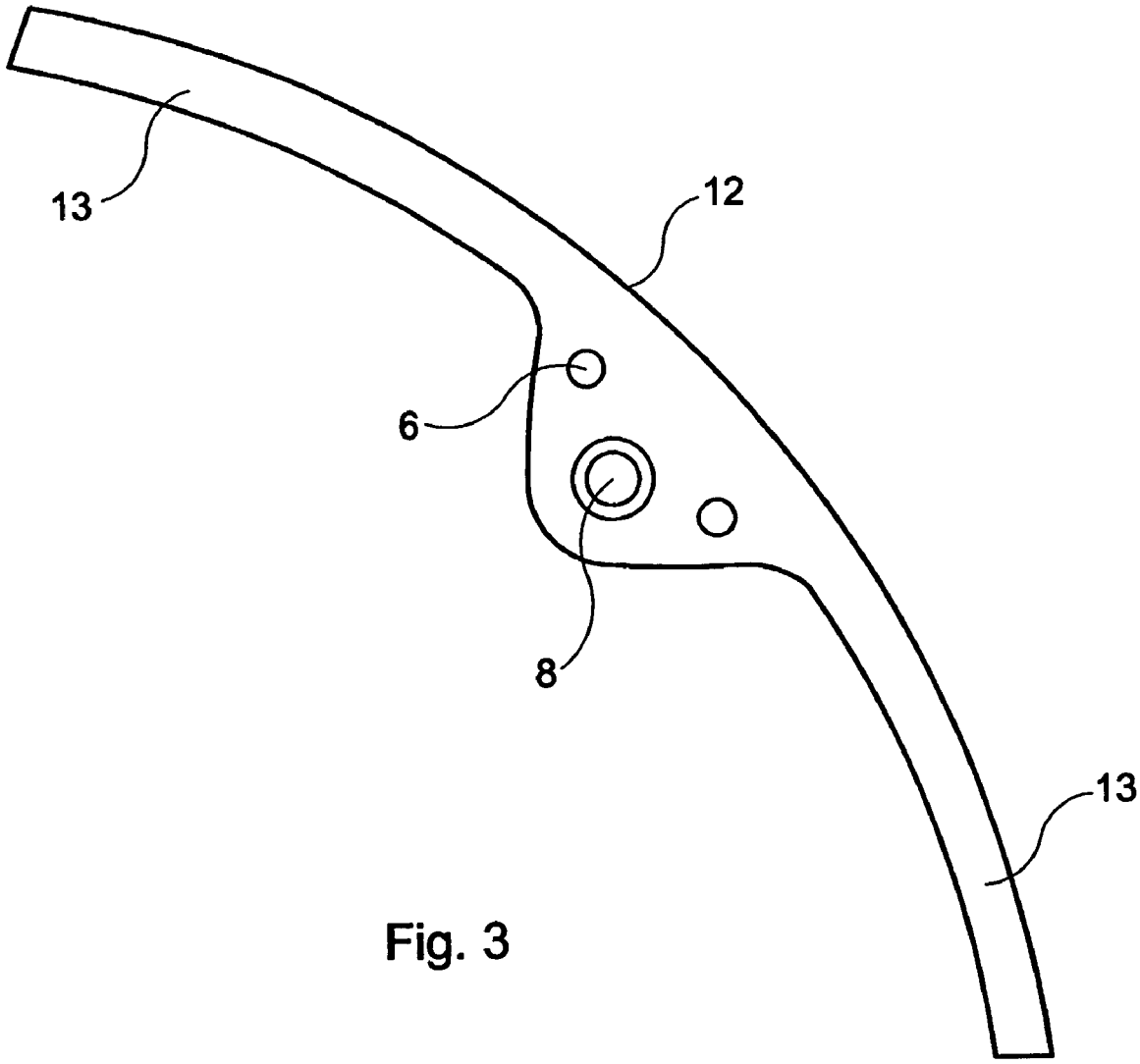
FIG. 3 shows a cross-section through an alternative embodiment of a shield tape arranged according to the invention.

FIG. 3 shows a further example of a shield strip 12 with conductors 6 and tubes 8 for one or several optofibres with a cross-section of the shield strip that is somewhat different. The shield strip in this case has been provided with wings 13, which it is intended should be directed towards each other at their ends at the periphery of the cable when several shields are arranged around the conductors in the cable construction.

Naturally, the invention is not limited to the embodiments described above and shown in the drawings, and it can be modified within the framework of the attached claims.

The invention claimed is:

1. An insulated electrical cable that includes:

at least two electrical conductors of metal, each surrounded by an electrically insulating layer;

an electrical shield that surrounds the conductors outside of the insulating layer; and a moisture barrier that surrounds the electrical shield;

at least two shield strips of the electrical shield, which are arranged in a region between the electrical conductors and the moisture barrier, which shield strips fill at least partially said regions, wherein the shield strips are of at least partially electrically conducting material, and wherein the shield strips are of a filler material that protects against corrosion and that may also have swelling properties on contact with water; and shield wires of metal, which are arranged in the shield strips and which are in electrical contact with them;

wherein the moisture barrier includes a layer of electrically conducting material that is in electrical contact with the shield wires at least via the shield strips.

2. The insulated electrical cable according to claim 1, wherein the moisture barrier has a join that extends along the cable, which join is in contact along at least part of its length with the shield strips and in this way can be pressed such that the join becomes tight and durable.

3. The insulated electrical cable according to claim 1, wherein the shield wires are of aluminum.

4. The insulated electrical cable according to claim 1, wherein the shield wires are of copper.

5. The insulated electrical cable according to claim 1, wherein the conducting layer of the moisture barrier is of aluminum.

6. The insulated electrical cable according to claim 1, wherein the conducting layer of the moisture barrier is of copper.

7. The insulated electrical cable according to claim 1, wherein a layer is present under the moisture barrier that swells on contact with water.

8. The insulated electrical cable according to claim 1, wherein the shield wires are arranged to be in direct electrical contact with the conducting layer of the moisture barrier.

9. The insulated electrical cable according to claim 1, wherein the shield wires have a cross-section of pointed shape in order to facilitate opening of the cable construction.

10. An insulated electrical cable that includes:

at least two electrical conductors of metal, each surrounded by an electrically insulating layer;

an electrical shield that surrounds the conductors outside of the insulating layer; and a moisture barrier that surrounds the electrical shield;

at least two shield strips of the electrical shield, which are arranged in a region between the electrical conductors and the moisture barrier, which shield strips fill at least partially said regions, wherein the shield strips are of at least partially electrically conducting material;

shield wires of metal, which are arranged in the shield strips and which are in electrical contact with them; and, a layer under the moisture barrier that swells on contact with water;

wherein the moisture barrier includes a layer of electrically conducting material that is in electrical contact with the shield wires at least via the shield strips.

* * * * *